US006840490B2

(12) United States Patent
Caluisi et al.

(10) Patent No.: US 6,840,490 B2
(45) Date of Patent: Jan. 11, 2005

(54) SYSTEM FOR THE REALIZATION OF STRUCTURAL REMAINING CAISSONS, FOR (REINFORCED) CONCRETE CASTING

(75) Inventors: Antonio Caluisi, Rieti (IT); Vicenzo Rendine, Rieti (IT)

(73) Assignee: Uniedil S.r.l., Rome (IT)

( * ) Notice: Subject to any disclaimer, the term of this patent is extended or adjusted under 35 U.S.C. 154(b) by 0 days.

(21) Appl. No.: 10/482,383

(22) PCT Filed: Jun. 12, 2002

(86) PCT No.: PCT/IT02/00388

§ 371 (c)(1),
(2), (4) Date: Dec. 31, 2003

(87) PCT Pub. No.: WO03/004789

PCT Pub. Date: Jan. 16, 2003

(65) Prior Publication Data

US 2004/0169123 A1 Sep. 2, 2004

(30) Foreign Application Priority Data

Jul. 2, 2001 (IT) ..... RM2001A0377

(51) Int. Cl.[7] ..... E04B 1/16

(52) U.S. Cl. ..... 249/33; 249/34; 249/42; 249/48; 249/219.1; 405/229; 405/233

(58) Field of Search ..... 249/33, 34, 36, 249/42, 48, 219.1; 405/228, 231, 232, 233

(56) References Cited

U.S. PATENT DOCUMENTS 3,672,626 A * 6/1972 Thornton ..... 249/48
3,945,601 A * 3/1976 Rowley ..... 249/48
4,958,800 A * 9/1990 Carlson ..... 249/219.1
6,419,204 B1 * 7/2002 Flathau ..... 249/48
6,668,511 B2 * 12/2003 Xammar ..... 249/48
6,676,102 B1 * 1/2004 Hambelton ..... 249/48

FOREIGN PATENT DOCUMENTS

DE 31 05 459 9/1982
WO WO 83/01975 6/1983

OTHER PUBLICATIONS

Patent Abstracts of Japan, vol. 016, No. 422 (M–1305), Sep. 4, 1992.

* cited by examiner

*Primary Examiner*—Frederick L. Lagman
(74) *Attorney, Agent, or Firm*—Young & Thompson

(57) ABSTRACT

A system for the realization of caissons for containing concrete during capstan and which are due not to be removed in a following phase, includes: panels for containing the concrete, with air spaces or with spaces filled with insulating material; inserts for connection panels in vertical and horizontal direction, for hooking the caisson to the reinforced concrete and for controlling the position of metal reinforcements; containing squares that may be realized out of various materials with holes for hooking the panels during casting and for the perfect falling plumb of the pillars; connection rods for the squares; nails for fixing the rods and squares; at the end of the concrete casting the last components—nails, rods and squares are removed so as to be used again.

3 Claims, 4 Drawing Sheets

SYSTEM FOR THE REALIZATION OF STRUCTURAL REMAINING CAISSONS, FOR (REINFORCED) CONCRETE CASTING

The present invention concerns a system for the realization and installation of structural caissons for (reinforced) concrete casting, which are due to remain as constituent of the final construction.

It is known that the method mostly used at present for the realization of conventional caissons is still the one that provides the use of boards, multilayer panels and similar, which are assembled by means of nails, brackets and other tie-beams.

This means that all above mentioned systems provide the disassembling of the caissons after a determined period from the casting. When the caissons are not disassembled, it usually depends on a problem of space.

It is the aim of the present invention to realize a new system for the realization of caissons due to remain in the final construction, consisting of different possible kinds of materials like bricks of any kind and shape, plastic materials, expanded or not expanded synthetic resins, metal, natural stone, wood and deriving products, ceramics and/or combinations thereof.

The system for the realization of caissons according to the present invention, for containing the cast concrete and for not being removed, comprises:

- panels out of bricks or other material having the function of containing the concrete, with air spaces or with spaces filled with insulating material;
- inserts for connecting the panels in vertical as well as in horizontal direction, for hooking the caisson to the reinforced concrete and for the control of the position of the metal reinforcements;
- containing squares that may be realized out of various materials with holes for the hooking of the panels during casting and for the perfect falling plumb of the pillars;
- connection rods for said squares;
- nails for fixing said rods and squares; at the end of the concrete casting said last components—nails, rods and squares—are removed so as to be used again.

The system comprising above mentioned components allows to perform concrete castings having many and considerable advantages:

- lowering of construction times: the joint and connection systems for the panels forming the caissons make the assembling operation particularly quick and annul the disassembling and recovering time for the elements used for the assembling;
- lowering of the industrial accidents and treatment of the waste: as it is known that the cuts, the nailing, the treatment with chemical disarming substances, the disassembling as well as the recovering of old construction elements, comprising the provisional works, imply high risks for the workers, all these risks are considerably reduced with the caissons according to the present invention, and polluting and polluted waste materials are annulled;
- thermo-acoustic insulation: it is known that concrete frameworks are considered as thermic bridges with the association of bothersome condensation phenomena, while the caissons according to the present invention consist of materials with low thermic conduction and contain air spaces, with a consequent considerable increase of insulating capacity;

- control and increase of the distance between the iron reinforcements from the outside: while it is known that the covering of the iron by the concrete is the essential and determining element for the duration and the stability in time of all realizations out of reinforced concrete, and that if during casting a outwards displacement of the iron cage occurs it may undergo oxidation which determines an increase of volume causing cracks, with the caissons according to the present invention this problem is brilliantly solved. In fact, the panels forming said caissons or the inserts assembling the same have a number of projections on the casting side which are used for the hooking thereof but also for preventing the moving of the reinforcements towards the casting limit and towards said caissons. Said caissons remaining in place form a further barrier to the penetration of oxygen contained in the air towards the reinforcements;
- coating and finishing of the surface out of working: while any kind of ornamental coating applied to the surfaces of the already performed casting has always greater difficulties of simple hooking resistant to time, the caissons according to the present invention, due to the used materials, easily solve said problem;
- the thermo-hygrometrical conduct and mechanical performances of the stable connection of the external vertical closings and the vertical partitions internal to the concrete structures vary from other materials, and any direct placement to the concrete implies, with time passing by, more or less visible cracks on the connection points; the finishing of the concrete provided by the caissons according to the present invention completely solves this problem;
- possibility of housing canalizations: while it is known that concrete must not be and may not be eroded for not to uncover the iron of the reinforcement, thus making it impossible to house raceways, with the caissons according to the present invention the panels containing the casting may be notched for making pass as many raceways as desired.

The present invention will be described more in detail hereinbelow relating to the enclosed drawings in which some embodiments are shown:

FIGS. 1, 2, 3 show three kinds of composition of the caissons according to the present invention, in particular:

- FIG. 1 shows the realization of a caisson with a series of four panels P, reciprocally joint by means of ends M and F, and that are provided with air spaces A for increasing their thermo-acoustic insulating capacity, and said panels have suitable ends D for maintaining said panels hooked to the concrete casting and for maintaining a determined distance with the edge of the irons of a cage G;
- FIG. 2 shows the realization of a caisson with a series of panels according to FIG. 1, with the difference that in this realization no air space 1 is provided for increasing the insulating capacity: this variant may be applied in those constructions where no particular thermo-acoustic insulation is required;
- FIG. 3 shows a square section of a caisson similar to the ones shown in FIGS. 1 and 2, consisting of a greater number of connection elements.

- FIG. 4 shows an axonometric view of the installation of caissons made out of throw-away bricks;

FIGS. 5, 6, 7 and 8 show, in different axonometric views, inserts for the connection of panels P;

FIGS. 9 and 10 show a containing square in an internal and outer axonometric view.

Figure 1:
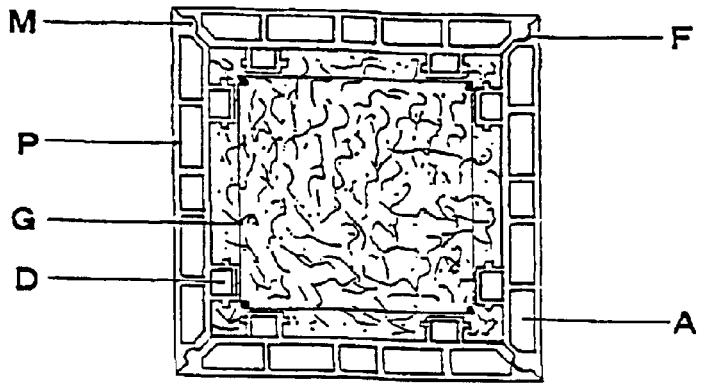
Figure 2:
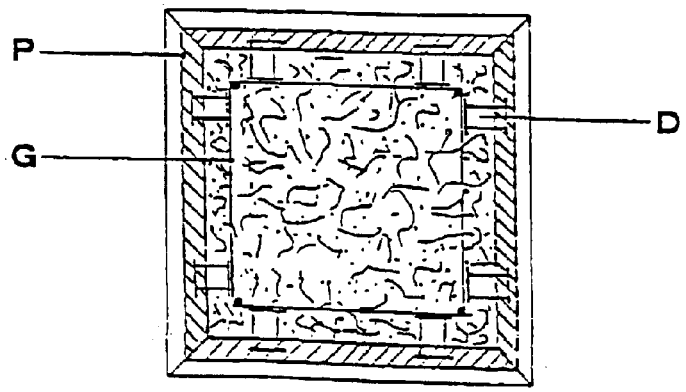
Figure 3:
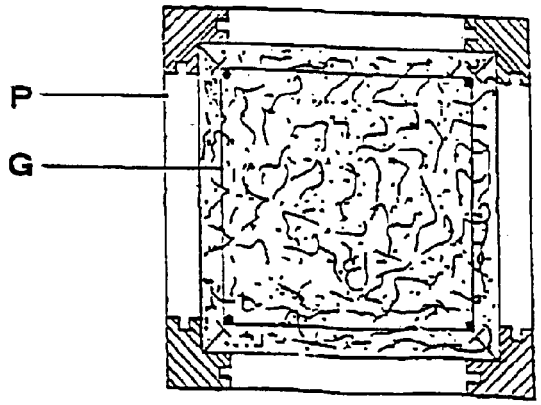
Figure 4:
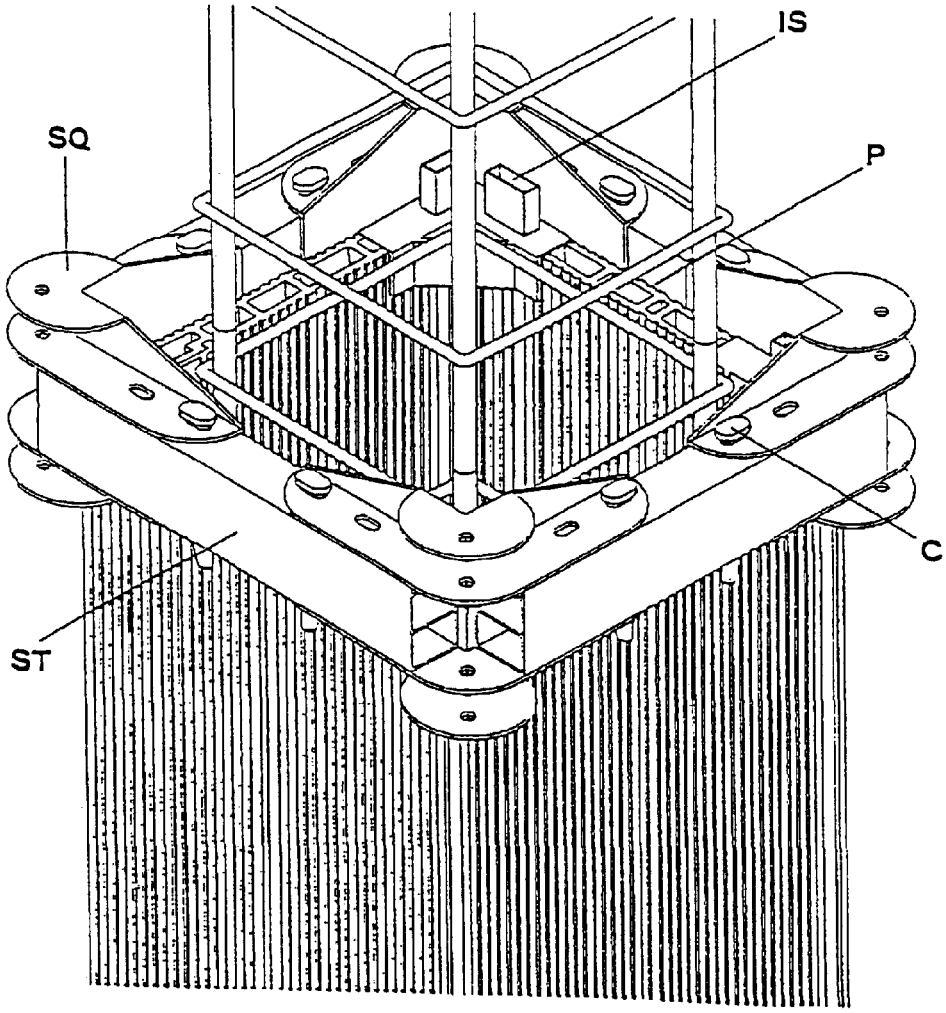
FIGS. 4, 5, 6, 7, 8, 9 and 10 show the elements for a particular realization of the system according to the present invention, and in particular.
Figure 7:
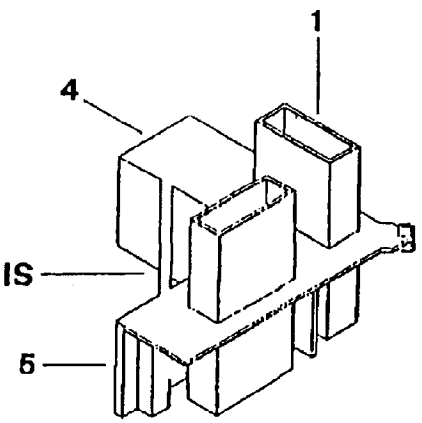
Figure 5:
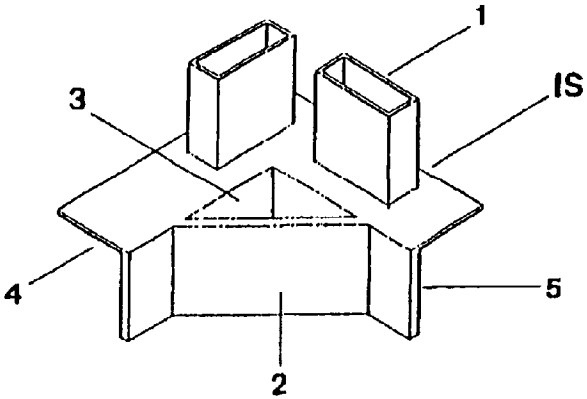
Figure 8:
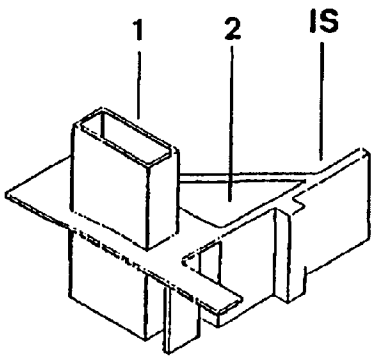
Figure 6:
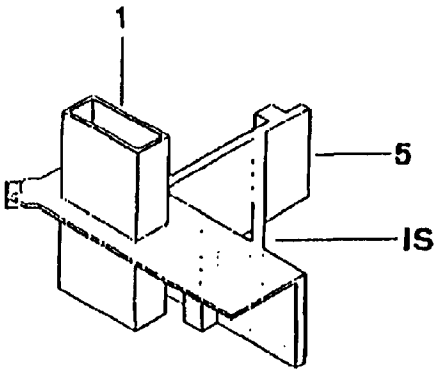
Figure 9:
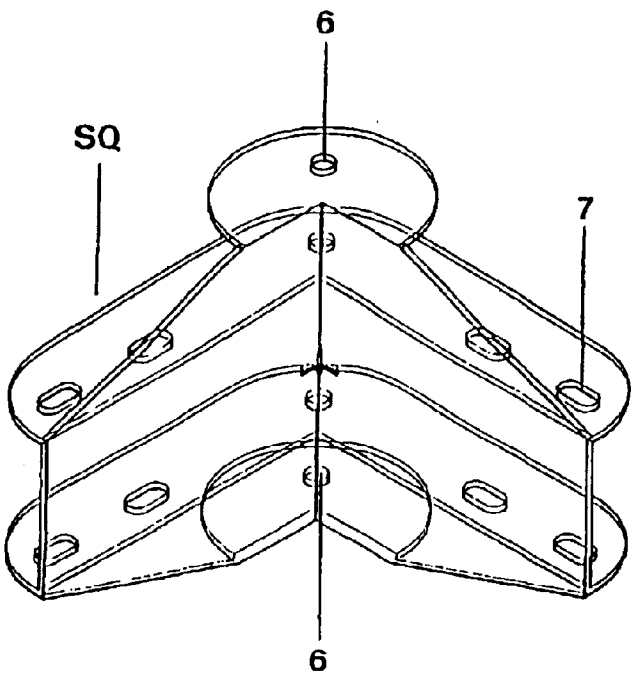
Figure 10:
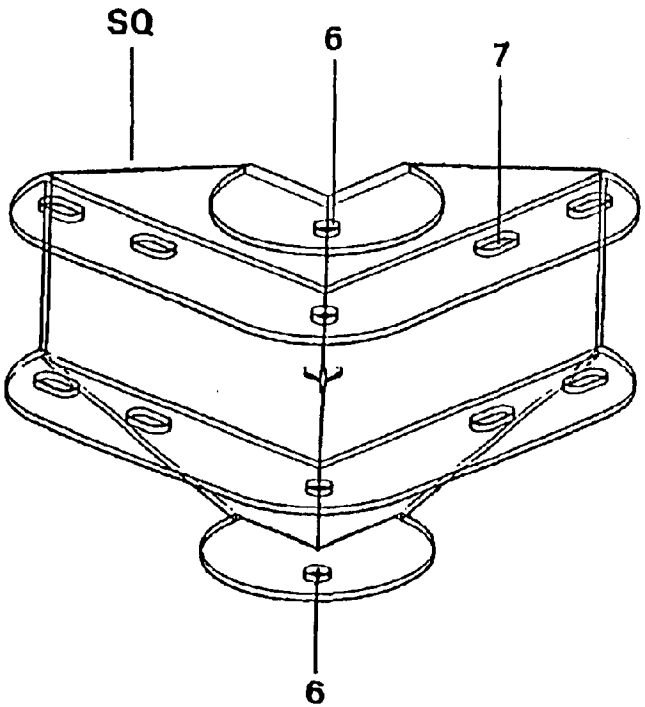

The enclosed figures show a system for the realization and installation of structural caissons for (reinforced) concrete, due to remain as a part of the final construction, comprising:

panels P that may be realized with bricks, plastic material, alveolar concrete, stone, ceramics, iron, wood, aluminum or combinations of the mentioned materials, having the function of containing the concrete, with air spaces or with spaces filled with any insulating material;

inserts IS provided with elements 1 for connecting panels P in vertical as well as in horizontal direction; with elements 2 for the control of the iron in the reinforcement (iron cover) and for hooking the panels by penetrating the concrete in holes 3; with support planes 4 and compensating distancing elements for the panels; and with elements 5 for resting said panels;

containing squares SQ that may be realized out of plastic material, iron, wood, aluminium or combinations thereof, with holes 6 for inserting the connecting rods for making the pillars fall plumb, and holes 7 for inserting nails C for connecting containing rods ST.

What is claimed is:

1. A system for the realization and installation of structural caissons for (reinforced) concrete castings, due to remain as a part of the final construction, characterized in:

panels (P) out of bricks or other material, having the function of containing the concrete, and which get reciprocally connected by means of ends (M and F) for the realization of parallelepiped caissons, furthermore containing air spaces (A) for increasing the thermo-acoustic insulating capacity, as well as suitable ends (D) for maintaining said panels hooked to the concrete casting and for maintaining a determined distance with the irons of a cage (G);

inserts (IS) provided with elements (1) for connecting panels (P) in vertical as well as in horizontal direction; with elements (2) for the control of the irons in the reinforcement (iron cover) and for hooking the panels by penetrating the concrete in holes (3); with support planes (4) and compensating distancing elements for the panels; and with elements (5) for supporting said panels;

containing squares (SQ) that may be realized out of plastic material, iron, wood, aluminium or combinations thereof, with holes (6) for inserting the connecting rods for making the pillars fall plumb, and holes (7) for inserting nails (C) for connecting containing rods (ST).

2. A system according to claim 1, characterized in that any material may be used that absorbs and/or balances thermic dilatations between the various components of said caissons and the casting, and any kind of shape for the joints for balancing the thermic dilatations.

3. A system according to claim 1, characterized in that said panels P forming said caissons and said inserts IS assembling said panels have, on the side of the casting, ends which are used for their hooking as well as for preventing the movement of the reinforcements towards the limit of the casting and towards said caissons which, remaining at their place, form a further barrier to the penetration of the oxygen contained in the air towards said reinforcements, thus preventing the oxidation of the irons inside the concrete.

* * * * *